United States Patent [19]

Warwick

[11] 4,367,614

[45] Jan. 11, 1983

[54] FIRE ENDURANCE DOOR

[75] Inventor: Charles H. Warwick, Lake Oswego, Oreg.

[73] Assignee: Tyre Mfg. Co., Inc., Alhambra, Calif.

[21] Appl. No.: 196,217

[22] Filed: Oct. 14, 1980

[51] Int. Cl.[3] ..... E06B 3/70

[52] U.S. Cl. ..... 52/455; 52/586; 52/780

[58] Field of Search ..... 52/455, 456, 780, 823, 52/490, 586

[56] References Cited

U.S. PATENT DOCUMENTS

| | | | |
|---|---|---|---|
| 1,533,881 | 4/1925 | Malarkey | 52/455 |
| 2,825,099 | 3/1958 | Simmons | 52/455 |
| 3,440,786 | 4/1969 | Weaver | 52/455 X |
| 4,265,068 | 5/1981 | Pomroy | 52/456 |

*Primary Examiner*—Carl D. Friedman

*Attorney, Agent, or Firm*—Kolisch, Hartwell & Dickinson

[57] ABSTRACT

A panel door having door frame members extending vertically and horizontally therein defining rectangular spaces in which panels are mounted. A panel is mounted in the door with its edge margins seating within channels extending along door frame members surrounding the panel. Fire endurance in the panel is achieved by the inclusion of fire-resistant strips having one set of margins fitted within grooves indented inwardly from the panel's edge margins. The opposite set of margins of the strips are fitted within grooves provided in the bases of the channels.

6 Claims, 4 Drawing Figures

FIRE ENDURANCE DOOR

This invention relates to a door construction, and more particularly, to a door construction which exhibits improved endurance to fire. The door, therefore, may be utilized in applications where an ordinary type of wooden door can't be used because of failure to meet fire endurance standards as set forth by building codes, etc.

A popular type of door includes panels distributed over the expanse of the door fitted within rectangular spaces defined by stiles and rails which are a part of the frame of the door. While forming an attractive door, the style of door described has not found acceptance where fire endurance is required, since the door is unable to withstand an endurance test without exhibiting flaming through the door after an unacceptably low time interval. Observations made of panel doors and failures therein as the result of fire endurance tests indicate that failure in a door initially occurs in the regions where panels have edges mounted within frame members of the door.

Various attempts have been made to improve the fire endurance of a panel type door. Those of which I am aware have not been successful, unless a construction is employed which results in an unacceptably high selling price for the door.

Generally, therefore, an object of this invention is to provide a panel type door which has been found to have improved fire endurance properties. A door prepared accoording to the invention has been subjected to fire endurance tests conducted according to standard procedures, and after 20 minutes of exposure of one side of the door to furnace temperatures exhibited no flaming on the unexposed door side.

Another object of the invention is to provide such a door which can be manufactured using, for the most part, conventional wood materials. The door may be manufactured at a cost which is not significantly greater than the cost of conventional doors.

A further object of the invention is to provide such a door which is relatively easily assembled in the manufacturing process.

These and other objects and advantages are attained by the invention, which is described hereinbelow in conjunction with the accompanying drawings, wherein.

Figure 1:
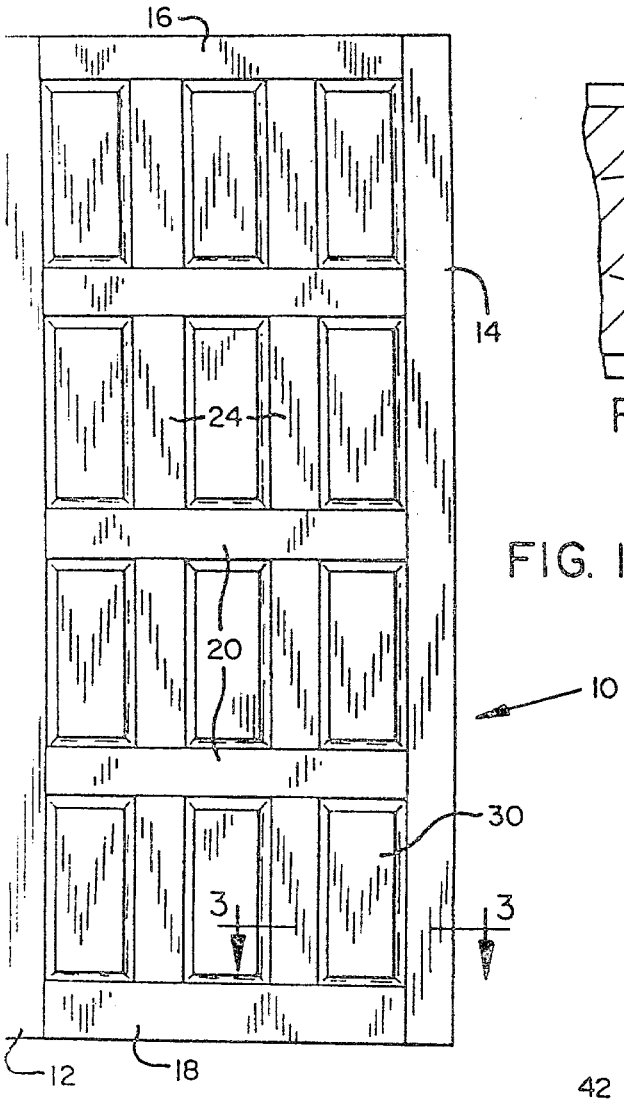
FIG. 1 is a front elevation of a panel door constructed according to the invention.

An analysis of door failures resulting from fire endurance tests has revealed to me that burning through a door, when one side of the door is ignited by exposure to high temperature, apparently starts in regions adjacent where panels in the door are mounted in the door frame members. This phenomena may be explained by the fact that as burning of one side of a door progresses, a loosening tends to occur where panels in the door are mounted in the door frame members. This accommodates the passage of gases around edges of the panels and through the door. The latter condition is followed by flames actually traveling through the door in regions where the panel margins are located, followed by further burning and deterioration of the panels.

To improve the fire endurance of a door, I have conceived of a door construction wherein panels in the door are each provided with thin strips of fire-resistant material seated in grooves indented inwardly from the edges of a panel. Door frame members which extend about a panel in the door have channels receiving the various edges of the panel, and are further provided with grooves indented inwardly from the bases of these channels receiving outer margins of these strips. With one set of margins of these strips seated in the grooves provided in the edges of a panel and the opposite set of margins seated in the grooves provided extending inwardly from the floors of the channels receiving these edges, the strips span any gap which may exist between the edge of a panel and the floor or base of a channel receiving it. The strips form an effective barrier to the passage of gases through the door around the edges of a panel, and the integrity of this barrier is maintained even as one side of a door erodes away as the result of burning.

Panel doors constructed generally as above described have been subjected to fire endurance tests conducted in accordance with standard testing procedures, wherein one side of a door is placed to close off an opening to a furnace and burning of the side of the door exposed to the furnace is produced by raising the furnace temperature. Quite surprisingly, the ability of a panel door to resist burning through the door may be increased substantially by the inclusion of the strips described.

Referring to the drawings, a door constructed as contemplated is shown at 10. The door includes laterally spaced vertical frame members 12, 14 extending in the direction of the height of the door, commonly known as stiles. Spanning these stiles are laterally spaced horizontal members 16, 18, commonly known as a top rail a and bottom rail, respectively. Also spanning the distance between the stiles, and between the top and bottom ends of the door, are frame members, or intermediate rails, such as those indicated at 20. Additional vertical frame members, such as those shown at 24, extend in the direction of the height of the door, such commonly being referred to as mullions. The various members ordinarily are made of wood, and the grain of the wood extends along the length of the members.

Figure 2:
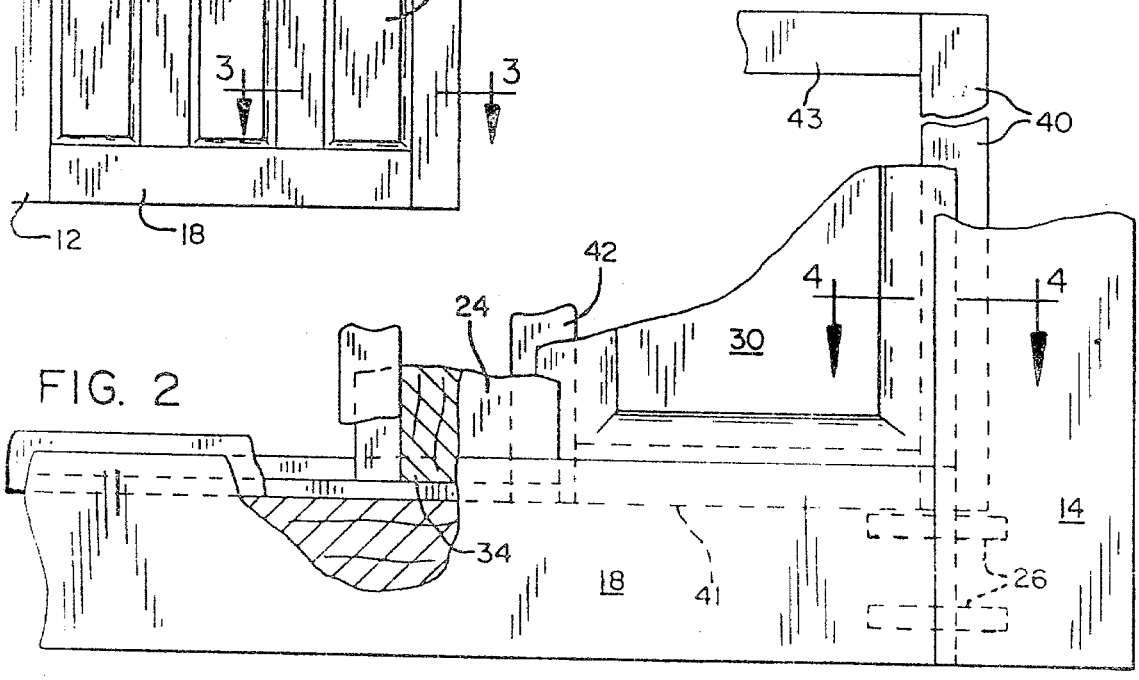
FIG. 2 is an enlarged, partially broken away view of the lower right corner of the door illustrated in FIG. 1.

The ends of the various rails, where such abut against the sides of the stiles, may be joined to the stiles by dowel pins as indicated by the dowel pins shown in dotted outline at 26 in FIG. 2.

The various horizontal and vertical members so far described define rectangular spaces distributed over the face of the door. These are filled by panels. Thus, and referring to FIG. 1, the frame member or stile 14, bottom rail 18, together with the intermediate rail which is closest to the bottom of the door and the mullion in the door which is closest to stile 14, as such is indicated in FIG. 1, define a rectangular space which is filled by a panel 30.

Figure 4:
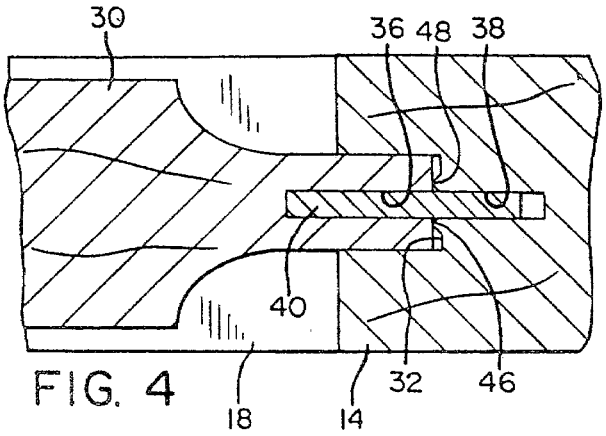
FIG. 4 is a view, on an even larger scale, taken generally along the line 4—4 in FIG. 2.

Stiles 12 and 14 are provided with a channel extending along the length of the stiles on the side edge of the stiles facing inwardly in the door, as exemplified by channel 32 shown in FIG. 4. A similar channel is provided on the bottom side edge of top rail member 16, along the upwardly facing side edge of the bottom rail member 18, and along the opposite side edges of the various intermediate rails and mullions. The various channels are provided to receive edge margins of the panels, which are seated within these channels.

The channels are also employed in the mounting of the ends of the various frame members in the door. Thus, mullion 24 shown in FIG. 2 is cut to have a tongue 34 at its end, which extends downwardly into the groove provided along the upper side edge of the bottom rail member. Similar tongues may also be provided in the frame members where such come up against another frame member in like manner.

Figure 3:
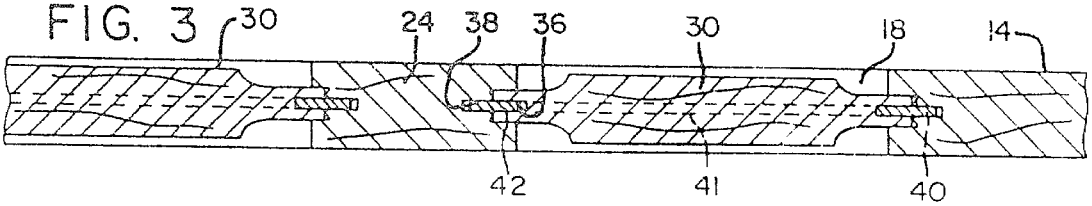
FIG. 3 is a cross-sectional view taken generally along the line 3—3 in FIG. 1.

Each of the panels 30 in the door is provided along each of its edge margins, with a groove, as exemplified by groove 36. Each of the channels in the frame members of the door are also provided with a groove which is indented inwardly from the floor or base of the channel, as exemplified by the groove shown in FIG. 3 at 38. Exch groove 36 in the side edge of a panel faces a groove 38 in the channel which seats the edge.

Shown at 40, 41, 42 and 43 are elongate fire-resistant strips, which may be strips made of an asbestos and cement mixture. One strip extends along each side edge of panel 30. Inner margins of each strip seat within a groove 36 provided in a panel edge. Outer margins of a strip sit within a groove 38 provided in the floor of a channel. As can be seen in FIG. 4, in the assembled door, each strip spans any gap which may exist between the seated edge of the panel and the floor of the channel which receives this edge. Each strip extends well into the rail member and the edge of the panel, respectively.

In the door, the strips of fire-resistant material extend from the frame members inwardly into the panel bounded by the frame members beyond the plane of the inwardly facing side edges of the frame members. The strips occupy a common plane extending through the middle of the panel. Strips fitted within the grooves of one set of opposed panel edge margins extend across the ends of strips fitted within grooves of another set of opposed panel edge margins.

It will be noted, with particular reference to FIG. 4, that extending along the floor of a channel, on opposite sides of the groove which joins with the floor, is a pair of elongate ribs, the ribs in FIG. 4 being indicated at 46, 48. The ribs are relatively narrow, i.e., have substantially less width than the width of the channel where the ribs are found. Furthermore, the ribs may be provided with a somewhat tapering cross section, with sides progressing up from the floor of the groove or channel which incline toward each other. The construction renders a rib crushable by reason of its size and wood composition, with the greatest crushability possessed along the outermost extremity of the rib.

In assembling the door, the ribs described in the floors of the channels perform an important function. Further explaining, they tend to position the panel properly, whereby the spacing between the various edges of the panel and the various floors of the channels in which these edges seat are substantially equal. This is because on completion of manufacture of the door, the edges of a panel become positioned against or closely adjacent the ribs within the channels which mount the panel.

The usual wooden panel in a door, such as panel 30, has grain extending along the length thereof or in the direction of the height of the door. When wood swells or expands because of a humidity change, such principally occurs in a direction extending transversely of the grain. As a consequence, on a tendency in panel 30 to expand, such principally is evidenced in an increase in the side-to-side dimension thereof, as the panel is viewed in FIG. 1. The spacing produced by the ribs described permits such expansion to occur with such compressing or slightly crushing the ribs. However, the edge of a panel does not come up against the floor of a channel with such force as to cause frame members in the door to separate.

The ribs described, by reason of their sloping side surfaces, also serve a function in assembling the door. More specifically, when inserting a fire-resistant strip into place within a groove 38, side surfaces of opposing ribs tend to funnel the edge of a strip into place which makes placement of the strip easier.

With the door of the invention, and when such is subjected to a fire endurance test, as fire consumes the side of the door which is exposed to heat in the test, there is charring and disintegration of wood material. However, the passage of gases around edges of a panel is prevented, even if on the exposed door side there is loosening of the panel's edges within the channels mounting these edges produced by the charring. The fire-resistant strips function to maintain a panel in place, and further to impede gas flow which would result in flame travel to the unexposed side of the door.

While a preferred embodiment of the invention has been described, it should be obvious that variations are possible without departing from the invention.

It is claimed and desired to secure by Letters Patent:

1. In a door, a first set of laterally spaced members extending in the direction of the height of the door and a second set of laterally spaced members extending in the direction of the width of the door spanning the space between the first set of members and connecting with the first set of members, said first and second set of members having inwardly facing side edges defining a rectangular space bounded by the members and said inwardly facing side edges having channels extending therealong recessed thereinto, a rectangular panel mounted within said space having elongate edge margins extending along the perimeter thereof with said edge margins seated within said channels, said edge margins of the panel having grooves extending their lengths and the bases of said channels having grooves extending along their lengths which face the grooves in said edge margins, and strips of fire-resistant material having one set of margins fitted within the grooves in the bases of said channels and an opposite set of margins fitted within the grooves in said edge margins of the panels.

2. The door of claim 1, wherein the strips of fire-resistant material extend inwardly into the panel beyond the planes of the inwardly facing side edges of said members.

3. The door of claim 1, which further includes a pair of elongate ribs protruding outwardly from the base of each of said channels and integral with the base of the channel, the ribs straddling a strip of fire-resistant material fitted within the groove which extends along the base of the channel.

4. The door of claim 1, wherein the strips occupy a common plane extending through the middle of the panel, strips fitted within grooves of one set of opposed panel edge margins extending across the ends of strips fitted within grooves of another set of opposed panel edge margins.

5. In a door, a pair of laterally spaced vertical frame members and a pair of laterally spaced horizontal frame members spanning the space between the vertical members and connecting with the vertical members, said members having inwardly facing side edges bounding a rectangular space, said frame members being provided with channels extending along their inwardly facing side edges which face said space, a rectangular panel means mounted within said space having top and bottom edge margins seating in the channels provided in the side edges of the horizontal members and opposite side edge margins seating in the channels provided in the side edges of the vertical frame members, fire-resistant strips forming a skirt extending out from the edge margins of the panel, said panel edge margins having grooves extending therealong and indented thereinto receiving one set of margins of the strips, said channels in the frame members having grooves extending therealong indented inwardly from the bases of the channels receiving an opposite set of margins of the strips.

6. The door of claim 5 which further includes a pair of elongate ribs in each channel protruding outwardly from and integral with base of the channel, said ribs straddling a strip of fire-resistant material fitted within the groove which is provided in the channel.

* * * * *